US005431205A

United States Patent [19]

Gebhard

[11] Patent Number: 5,431,205

[45] Date of Patent: Jul. 11, 1995

[54] DISPENSING SYSTEM FOR BOTTLED LIQUIDS

[76] Inventor: Albert W. Gebhard, 2101 E. Alameda Ave., Denver, Colo. 80209

[21] Appl. No.: 134,055

[22] Filed: Oct. 8, 1993

[51] Int. Cl.[6] ..... B65B 39/00

[52] U.S. Cl. ..... 141/351; 141/353; 141/364; 141/286; 220/287; 251/149.6

[58] Field of Search ..... 141/351, 352, 353, 354, 141/356, 357, 359, 363, 364, 106, 286, 292, 289, 319, 320, 321, 322; 220/287; 222/185, 559, 514; 251/149.6, 149.7

[56] References Cited

U.S. PATENT DOCUMENTS

| | | | |
|---|---|---|---|
| 996,127 | 6/1911 | Patnaude | 141/353 |
| 1,658,227 | 8/1928 | Davis | 141/18 |
| 1,946,314 | 2/1934 | Desmond | 141/356 |
| 3,381,838 | 5/1968 | McClain et al. | 215/321 |
| 4,074,986 | 2/1978 | Frahm et al. | 55/502 |
| 4,090,631 | 5/1978 | Grussen | 215/329 |
| 4,281,779 | 8/1981 | Shepard | 222/501 |
| 4,322,012 | 3/1982 | Conti | 215/329 |
| 4,699,188 | 10/1987 | Baker et al. | 141/18 |
| 4,874,023 | 10/1989 | Ulm | 141/286 |
| 4,902,320 | 2/1990 | Schroer et al. | 55/385.1 |
| 4,951,723 | 8/1990 | Hoeptner, III | 141/351 |
| 4,972,976 | 11/1990 | Romero | 141/353 |
| 4,991,635 | 2/1991 | Ulm | 141/346 |
| 5,139,666 | 8/1992 | Charbonneau et al. | 210/263 |
| 5,213,309 | 5/1993 | Makishima | 251/149.6 |
| 5,253,842 | 10/1993 | Huebscher et al. | 251/149.6 |
| 5,289,855 | 3/1994 | Baker et al. | 141/351 |

*Primary Examiner*—Henry J. Recla
*Assistant Examiner*—Steven O. Douglas
*Attorney, Agent, or Firm*—John E. Reilly

[57] ABSTRACT

A dispensing system for bottled liquids includes a bottle cap having a slide valve biased by a spring to a closed position. The cap includes internal threads and an internal groove for engagement with both threaded and snap-on type closure bottles. A valve actuator includes a breather ring having a skirt provided with a gasket for sealing engagement with a rim of a crock. An air filter connected to the breather ring forms an airway for venting ambient air into the crock and bottle. A bottle neck seal having an internal frusto-conical seat portion includes an annular stepped outer surface for engagement with a complementary formed internal stepped surface on the breather ring. A valve actuating funnel includes a flared end portion terminating in an annular flange secured by screws to the breather ring. A tubular extension of the funnel extending downwardly within the crock terminates in a floor provided with a plurality of circumferentially-spaced liquid outlet ports. A valve actuating probe extends centrally upwardly from the floor within the extension of the funnel. In use, the neck and mouth portion of a bottle inverted within the breather ring is disposed in sealed relation within the extension of the funnel. A tip of the probe engages the bottle mouth slide valve and forces it to an open position, allowing liquid contents of the bottle to flow into the crock to a level of the bottle-mouth for dispensing via a spigot on the crock.

20 Claims, 2 Drawing Sheets

DISPENSING SYSTEM FOR BOTTLED LIQUIDS

BACKGROUND AND FIELD OF THE INVENTION

This invention relates to dispensing apparatus and more particularly relates to systems for dispensing bottled liquids, particularly water, from a large inverted bottle known as a carboy. A wide variety of such dispensing systems are known in the prior art in which water from the inverted bottle flows into a reservoir in a dispenser housing and rises in the reservoir to a level just covering the mouth of the bottle. According to well known principles of fluid mechanics, air pressure then prevents the remaining contents of the inverted bottle from flowing into and overflowing the reservoir. When water is dispensed by user manipulation of a spigot or tap on the dispenser housing, the fluid level in the reservoir is automatically replenished by water from the inverted bottle. In order to allow water flow out of the open mouth of the inverted bottle, air must be allowed to bubble up into the bottle. In order to maintain hygienic conditions, it is desirable that the vent air be filtered to preclude introduction of contaminants into the bottle and reservoir.

A wide variety of dispensing systems for dispensing water from inverted bottles or carboys are known in the prior art. Such conventional dispensing systems fall into two main categories or types. The first category is a water cooler type in which a dispenser housing or base includes a refrigeration system for cooling water in a dispenser reservoir. Such water cooler systems may also include a heating system for optionally heating the water for use in making hot beverages such as coffee, tea, etc. The second category of such bottled water dispensers provide a relatively simple ceramic crock or other vessel having an open upper neck provided with a support for receiving an inverted bottle therein. Uncooled water from the crock is then dispensed on demand through a tap or spigot. The fluid level in the crock is maintained at the level of the mouth of the inverted bottle. Both the water cooler-type and crock-type dispensers must include a system for venting ambient air into the inverted bottle to allow the water to flow therefrom. A wide variety of different venting and filtration systems have been proposed in the prior art for allowing the passage of filtered ambient air into the dispenser reservoir and inverted bottle.

An additional problem associated with such inverted bottle water dispensers is the spillage of water from the bottle during installation and removal from the dispenser. In order to overcome this problem, the prior art has proposed the provision of a valve mechanism in the mouth of the water bottle which is opened automatically upon installation of the bottle in the dispenser. U.S. Pat. No. 4,991,635, which issued to J. Ulm on Feb. 12, 1991, discloses a dispensing system for water cooler bottles for use with water cooler-type dispensers, rather than crock-type dispensers. The patent to Ulm discloses a dispensing system in which a slide valve in the bottle mouth is automatically opened by engagement with a centrally disposed vertically extending valve actuating rod positioned in a cylindrical stem portion of a funnel-shaped bottleneck receiving socket. The valve actuating rod and slide valve includes frictional engaging portions such that the rod pushes the slide valve open and subsequently pulls the slide valve closed. The bottleneck receiving socket also includes a second valve automatically opened upon insertion of the inverted bottle for allowing flow to the water cooler reservoir. When the bottle is removed from the supporting socket, both the valve in the bottle mouth and the water cooler reservoir inlet valve automatically close. The system disclosed by the patent to Ulm also includes an air vent provided with a filter for allowing filtered ambient air into the water cooler reservoir and subsequently into the inverted bottle for venting purposes. The air vent includes a ball check valve for preventing reservoir overflow through the air vent in the event that the inverted water bottle contains a pinhole leak or hairline crack.

The dispensing system described by the patent to Ulm is relatively complex and requires close tolerances in the valve system to ensure a proper fit between the valve actuating rod and the bottle mouth slide valve. Misalignment between the actuating rod and the slide valve can cause failure of the valve to open when the bottle is inverted into the reservoir and can also result in failure of the slide valve to close when the bottle is removed, thus giving rise to potential leakage and bottle contamination problems. Additionally, the Ulm dispensing system is not useable with crock-type dispensers, but only with the more expensive water cooler-type dispensers.

SUMMARY OF THE INVENTION

Accordingly, it is an object of the present invention to provide a novel and improved dispensing system for use with water dispensers.

Another object of the present invention is to provide an improved dispensing system for bottled liquids which may be easily retro-fitted to conventional crock-type dispensers without the use of fasteners or tools.

A further object of the present invention is to provide an improved dispensing system for bottled liquids including a bottle venting air filter assembly which is readily accessible for cleaning and/or replacing a filter element.

Still another object of the present invention is to provide an improved dispensing system including a bottle cap and valve assembly conformable for use with both threaded and snap-on type closure water bottles.

A still further object of the present invention is to provide an improved dispensing system for bottled liquids which is susceptible of low cost manufacture and installation and thus economically available to the consuming public.

Yet another object of the present invention is to provide an improved dispensing system for bottled liquids including an automatically actuated bottle mouth valve which does not require precise manufacturing tolerances.

In order to achieve these and other objects of the invention, the present invention resides in an improved liquid dispensing apparatus having a reservoir from which liquid is to be dispensed and which is provided with an upper rim surrounding an entrance into the reservoir. A bottle, when inverted, has a neck portion insertable into the entrance of the reservoir. A bottle neck seal and air filter assembly disposed between the bottle and the rim includes an air entrance port and air filter for filtering ambient air passing through an air passage into the reservoir and bottle. A valve actuator funnel is disposed between the bottle neck seal and air filter assembly and the reservoir for downward suspension into the reservoir. A valve member is biased by a spring to a position normally closing the neck portion of the bottle. Valve release means is disposed in the valve actuator funnel such that upon insertion of the neck portion into the funnel suspended within the entrance of the reservoir the valve release means will move into registry with the valve member to open the neck portion for the release of liquid from the bottle into the reservoir.

More specifically, the improved dispensing system for bottled liquids according to the present invention includes a bottle cap having a slide valve biased by a spring to a closed position for sealing the bottle mouth. The cap includes internal threads and an internal groove for engagement with both threaded and snap-on type closure bottles. A unitary valve actuator and vent air filter assembly includes a breather ring having a radial skirt portion provided with a gasket ring for forming an airtight seal with a top rim surrounding an open neck of a dispenser crock. An air filter assembly includes a housing extending radially outwardly from the breather ring and having an airway for venting ambient air into the crock. An easily accessible air filter cartridge filters ambient air prior to passage into the crock. An elastomeric bottle neck seal includes an annular stepped outer surface for engagement with a complementary internal stepped surface on the breather ring. The bottle neck seal includes a frusto-conical seat for engagement with a neck portion of an inverted bottle. A valve actuating funnel includes a flared upper end portion terminating in an annular flange secured to the breather ring, a tubular extension at its lower end provided with a plurality of circumferentially-spaced liquid outlet ports, and a valve-actuating probe extends centrally upwardly from the lower end within the tubular extension of the funnel. In use, the neck and mouth portion of a bottle are inverted within the breather ring and disposed within the tubular portion of the funnel. The upper tip of the probe engages the bottle mouth slide valve and forces it to an open position, allowing liquid contents of the bottle to flow into the crock to the level of the bottle mouth.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

Figure 1:
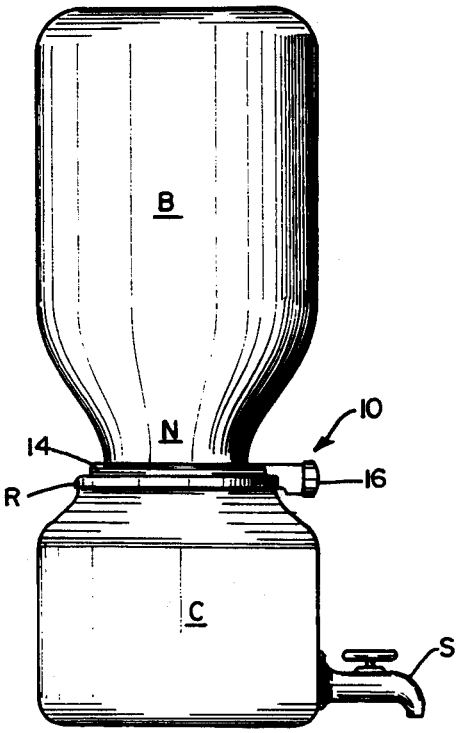
FIG. 1 is a side elevational view illustrating the dispensing system for bottled liquids according to the present invention installed on a conventional dispensing crock.
Figure 2:
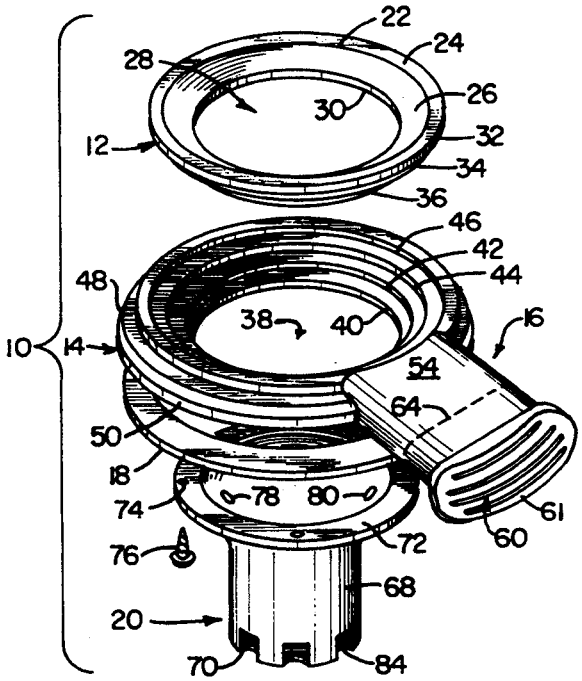
FIG. 2 is an exploded perspective view illustrating the valve actuator and air filter assembly of the dispensing system of the present invention.
Figure 3:
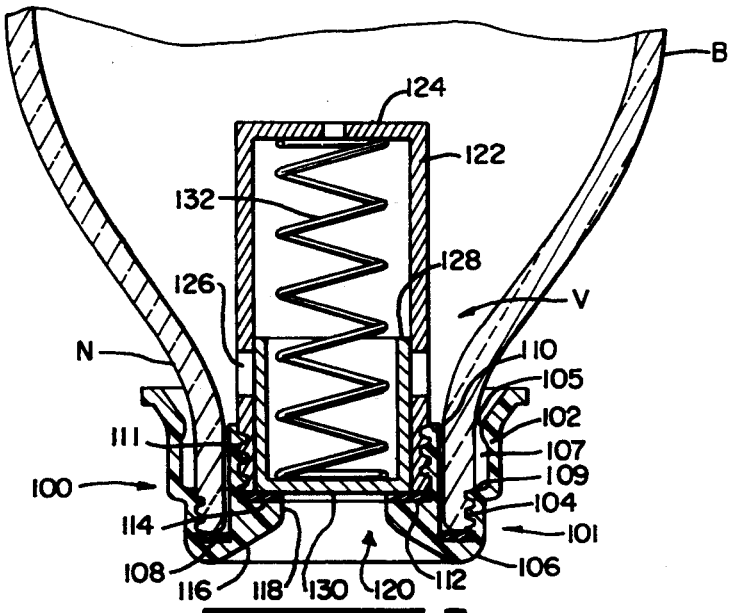
FIG. 3 is a longitudinal cross-sectional view illustrating the bottle mouth closure and valve assembly of the dispensing system of the present invention.

Referring now to the drawings, wherein like reference numerals designate corresponding structure throughout the views, and referring in particular to FIGS. 1 through 4, an improved dispensing system for bottled liquids according to a preferred embodiment of the invention includes a valve actuator and air filter assembly 10 comprising a bottleneck seal 12, a breather ring 14, an air filter assembly 16, a gasket 18, and a valve support and actuating funnel 20. The bottleneck seal 12 comprises an annular body 22 having a circular planar top face 24 and an interior frusto-conical seat 26 adapted for sealing engagement with the tapered neck N of a conventional bottle B inverted within a conventional reservoir such as a ceramic dispensing crock C of the type including a discharge tap or spigot S. A cylindrical wall portion 30 of the bottleneck seal 12 surrounds a centrally disposed bottleneck receiving aperture 28 through which a spout or mouth portion of the bottle B is received. An external surface of the seal 12 has an annular stepped construction including axially spaced annular steps 32, 34, and 36 of progressively decreasing diameter. The breather ring 14 includes a central circular bottleneck-receiving aperture 38 surrounded by a cylindrical wall 40. An interior portion of the wall 40 has an annular, stepped construction including axially spaced annular steps 42, 44, and 46 of progressively increasing diameter. In an assembled condition, the bottleneck seal 12 is placed in nested relation within the breather ring 14 such that the annular steps 32, 34, and 36 on the external surface of the seal 12 are complementary to and engage the respective internal annular steps 46, 44, and 42 of the breather ring 14. The mating stepped construction of the bottleneck seal 12 and the breather ring 14 allows a plurality of different bottleneck seals 12 having various differently dimensioned seat surfaces 26 to be rapidly substituted to accommodate various different standard-sized bottles B.

Figure 4:
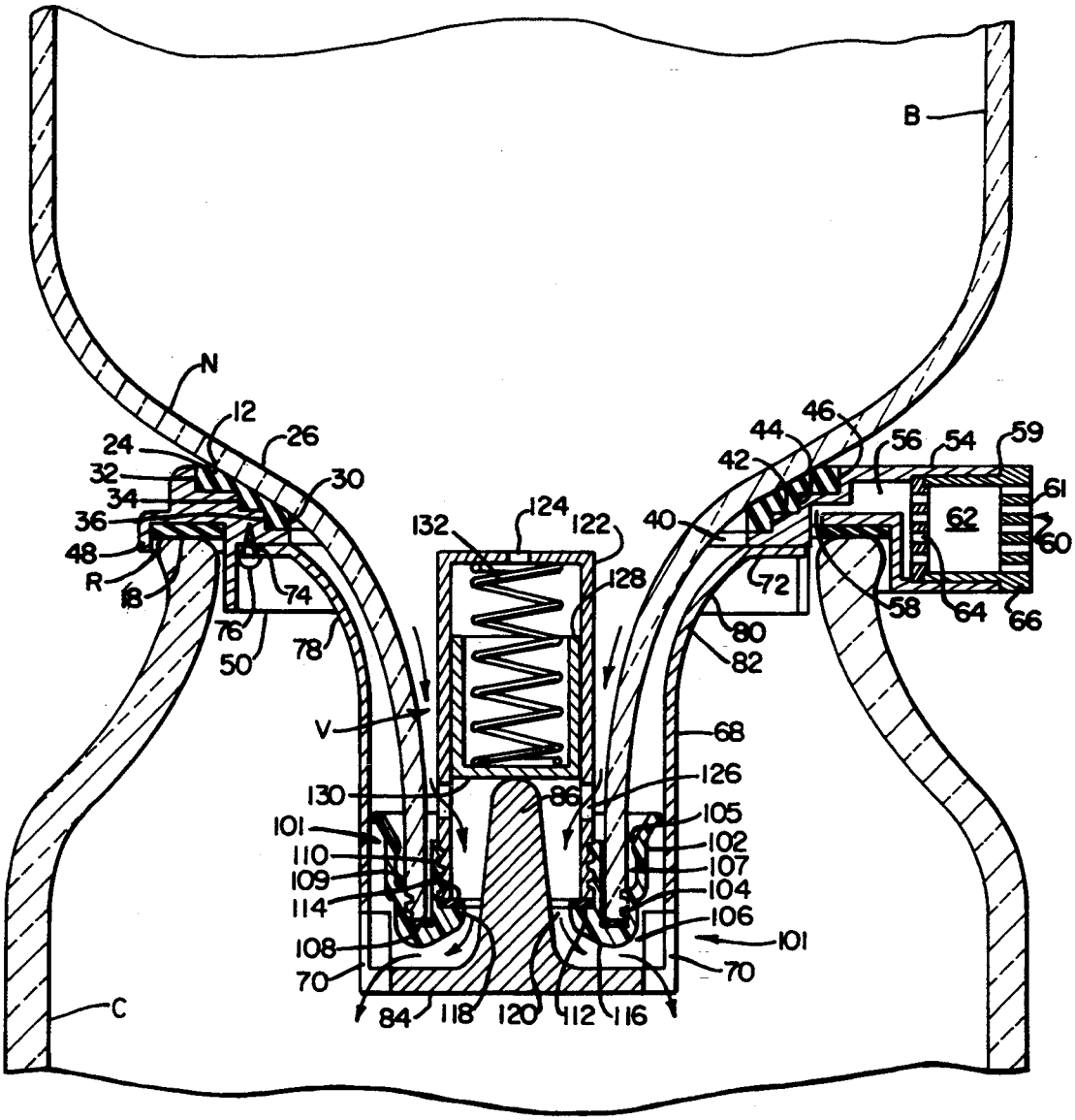
FIG. 4 is a longitudinal cross-sectional view illustrating the dispensing system for bottled liquids of the present invention installed on a conventional dispensing crock.

A relatively short, external skirt 48 extends circumferentially around the breather ring 14 and defines the radially outermost extent thereof. The skirt 48 is dimensioned to abut and overly a circular top rim R of a conventional dispensing crock C, such that an outer cylindrical sidewall of the skirt 48 depends slightly downwardly over the rim R. As shown in FIG. 4, a circular elastomeric gasket 18 is preferably interposed between the breather ring 14 and the rim R. A second, longer, internal skirt 50 forms an axially downward extension of the wall 40 and is dimensioned for insertion within an open neck of the crock C. The inner skirt 50 preferably has a diameter slightly less than the diameter of the opening in the crock C, such that an annular clearance space is formed between an inner surface of the rim R and an outer surface of the skirt 50. The skirt 50 surrounds a radially extending planar circular seat 52 on a bottom surface of the breather ring 14 adapted for securement to the valve release funnel 20.

The air filter assembly 16 includes a flattened tubular-shaped air filter housing 54 extending radially outwardly from the breather ring 14 and integrally molded therewith. The air filter housing 54 defines an internal vent air passage or airway 56 terminating in an arcuate air outlet slot 58 in the breather ring 14 disposed radially inwardly of an inner edge of the gasket 18, and in alignment with the annular clearance space between the skirt 50 and the rim R. A peripheral end face 59 of the air filter housing 54 surrounds an opening dimensioned for insertion of a replaceable air filter cartridge 60. The air filter cartridge 60 includes an outer surface 61 provided with a plurality of slots forming an air intake grating for allowing ambient air to pass through a conventional filter media 62, and then through a screen 64 into the air passage 56. The air filter cartridge 61 includes an outwardly projecting rim 66 dimensioned for abutment with the end face 59 of the air filter housing 54. In an assembled condition, the air filter cartridge 60 extends radially outwardly of the rim R of the crock C in an easily accessible location for convenient replacement and/or cleaning.

In order to support the valve release member or probe 86, the valve actuator funnel 20 includes a tubular extension 68 having a lower closed terminal end or floor 84 and a plurality of evenly circumferentially spaced water outlet ports 70. The extension 68 is connected to a radially extending annular flange 72 by a smooth exponentially curved upwardly flaring portion 82 provided with a pair of diametrically opposed air vents 78 and 80. The flange 72 of the funnel 20 is secured to the circular seat 52 of the breather ring 14 by a plurality of screws 76 received through a plurality of circumferentially spaced apertures 74 in the flange 72. Accordingly, in an assembled condition, the cylindrical extension 68 of the funnel 20 extends centrally downwardly within the crock C, as shown in FIG. 4, and a generally frustoconical probe 86 is disposed centrally of the extension 68 for upward axial extension from the floor 84 to terminate in a hemispherical tip portion.

Conventional water bottles are provided with three different bottle neck configurations for cooperation with various conventional closures. A first type, illustrated in the drawings at B, includes a threaded terminal neck or spout portion for engagement with threaded caps. A second type includes a radially enlarged external rim portion for engagement with snap-on type caps. A third type includes both an enlarged rim and external threads and is adapted for use with either threaded or snap-on type closures. Conventional water bottle caps and closures are either snap-on or threaded; no combined snap-on and threaded closures have been heretofore proposed.

In accordance with the present invention, a valve assembly 100 is comprised of a slide valve unit V and an adaptor 101 at one end of the unit V, the latter serving as an end fitting for secure, sealed engagement of the valve within any of the conventional neck portions described. Thus, the adaptor 101 has inner and outer circumferentially spaced walls 110 and 102 with an annular clearance space 107 therebetween, the walls being joined together at one end by a common circular rim or seat 106. A seal ring 108 is inserted in the space 107 against the interior surface of the seat 106 between the inner and outer walls and is dimensioned together with the annular clearance space 107 for insertion of a mouth portion of the bottle B through the space 107 into sealed engagement with the ring 108. The inner wall 110 includes internal threads 111 to mate with complementary external threads on the valve unit 120, and an internal shoulder 112 at one end of the threads 111 supports another seal ring 114 for the purpose of forming a watertight seal with an end of the valve unit 120. A beveled surface portion 116 merges into a cylindrical sidewall 118 beneath the shoulder 112 to define an outlet aperture 120.

The outer wall 102 has internal threading 104 adjacent to the seat 106 which is dimensioned for engagement with complementary external threads on the neck portion end of the bottle B; and a radiused annular ledge 109 at one end of the internal threading 104 opposite to the ring 106 is adapted for abutment with an end portion of a conventional snap-on closure type water bottle, not shown. The wall 102 continues in an axial direction away from the ledge 109 to terminate in a flared skirt portion 105 at the entrance to the end fitting.

The valve unit V preferably is a slide valve having a tubular valve body 122 closed at one end 124 and open at the opposite end to receive a generally cup-shaped end portion 127. The end portion 127 has a circular wall 128 in inner telescoping relation to the body 122 and an end wall or face 130 which abuts seal ring 108 when assembled with the adaptor 101. A coiled compression spring 132 is mounted under compression between the end portions 124 and 130 to bias the end portion 127 against the seal ring 108 such that the circumferentially spaced ports 126 in the valve body 122 are normally closed by the wall 128 of the end portion 127. The valve unit V and the adaptor 101 are each preferably formed from a polyurethane material possessing a relatively limited degree of flexibility.

When the bottle B is inverted within the crock C as shown in FIG. 4, the neck and mouth portion of the bottle B are received within the tubular portion 68 of the funnel 20. The hemispherical tip portion of the probe 86 abuts the valve face 130, thus forcing the valve 128 to the open position shown in FIG. 4 against the bias of the valve spring 132. In this condition, water or other liquid contents of the bottle B flows downwardly through the inlet port 126, through outlet aperture 120, around probe 86, and outwardly through outlet ports 70 into the crock C. As is generally well known, the bottle B must be vented in order to allow fluid flow therefrom. The requisite vent air passes through the inlet grate 61 of the filter cartridge 60, through the filter media 62, subsequently through the outlet screen 64, and then through air passage 56 and the outlet slot 58, and then through the annular clearance space between the outer surface of the breather ring skirt 50 and the inner surface of the rim R into the crock C. The now filtered ambient air then passes through the vent apertures 78 and 80 in the flaring portion 82 of the funnel 20, and subsequently through the ports 126 into the bottle B. When the fluid level within the crock C rises to a level sufficient to block the outlet aperture 120 in the mouth of the bottle, fluid flow from the bottle B will stop due to the inability of the bottle B to vent further to overcome ambient air pressure.

When using a smaller size water bottle, the combined weight of the bottle and remaining water when the bottle is nearly empty might not be sufficient to overcome the force of the spring 132, resulting in closing of the valve piston 128 and a slight upward movement of the bottle away from the seal 12. To drain the small remaining quantity of water, the bottle may be manually depressed to engage the tip of the probe 86 with the valve piston 128.

The slide valve 128 and actuating probe 86 arrangement of the present invention does not require mutual interlocking engagement between the valve 128 and probe 86 and thus obviates the need for close manufacturing tolerances and precise alignment of the invented bottle within the funnel 20.

As can now be readily appreciated, the valve actuator and air filter assembly 10 may be readily retro-fitted to a conventional dispenser crock C, without the use of any fasteners or tools. Accordingly, the assembly 10 may also be readily removed for cleaning purposes. While the valve actuator and air filter assembly 10 has been illustrated and described principally in connection with application to crock-type dispensers, the principles and concepts of the present invention may be readily adapted to water cooler-type dispensers.

It is to be understood, however, that even though numerous characteristics and advantages of the present invention have been set forth in the foregoing description, together with details of the structure and function of the invention, the disclosure is illustrative only, and changes may be made in detail, especially in matters of materials, shape, size and arrangement of parts within the principles of the invention to the full extent indicated by the broad general meaning of the terms in which the appended claims are expressed and reasonable equivalents thereof.

I claim:

1. In liquid dispensing apparatus having a reservoir from which liquid is to be dispensed and which is provided with an upper rim surrounding an entrance into said reservoir, and a bottle which, when operably associated in an inverted orientation with said dispensing apparatus, has a neck portion inserted into said entrance of said reservoir, the improvement comprising:

sealing means between said bottle and said rim including an air entrance port and filter means for filtering ambient air passing through an air passage into said reservoir and said bottle;

valve support means including a male valve member disposed between said bottle and said reservoir and at least partially disposed within said reservoir; and valve means interposed between said neck portion of said bottle and said valve support means including a female valve member and a spring biasing said female valve member to a position normally closing said neck portion of said bottle whereby insertion of said neck portion into said entrance of said reservoir will cause said female valve member to move into registry with said male valve member to open said neck portion for the release of liquid from said bottle into said reservoir.

2. In apparatus according to claim 1, wherein said filter means includes an outwardly extending air filter assembly disposed externally of said reservoir which is readily accessible for cleaning and replacement without removal of said bottle.

3. In apparatus according to claim 1, wherein said sealing means includes a first member having an outer surface with a plurality of annular steps nested within a second member having a complementary annular stepped inner surface.

4. In apparatus according to claim 3, wherein said first member comprises an elastomeric bottle neck seal including a frusto conical seat portion for engagement with a neck portion of said bottle.

5. In apparatus according to claim 3, wherein said second member comprises a breather ring dimensioned for support on said rim.

6. In apparatus according to claim 5, wherein said valve support means comprises an upwardly opening funnel extending downwardly from said breather ring.

7. In apparatus according to claim 6, wherein said male valve member comprises a probe centrally upstanding from a floor of said funnel.

8. In apparatus according to claim 7, further comprising a plurality of liquid outlet ports in said funnel surrounding said probe.

9. In liquid dispensing apparatus having a reservoir from which liquid is to be dispensed and which is provided with an upper rim surrounding an entrance into said reservoir, and a bottle which, when operably associated in an inverted orientation with said dispensing apparatus, has a neck portion inserted into said entrance of said reservoir, the improvement comprising:

a bottle neck seal and air filter assembly disposed between said bottle and said rim including an air entrance port and air filter for filtering ambient air passing through an air passage into said reservoir and bottle;

a valve actuator funnel disposed between said bottle neck seal and air filter assembly and said reservoir and at least partially disposed within said reservoir;

a valve member including a spring biasing said valve member to a position normally closing said neck portion of said bottle; and valve release means in said valve actuator funnel, whereby insertion of said neck portion into said funnel suspended within said entrance of said reservoir will cause said valve release means to move into registry with said valve member to open said neck portion for the release of liquid from said bottle into said reservoir.

10. The apparatus of claim 9, wherein said sealing means includes a first member having an outer surface with a plurality of annular steps nested within a second member having a complementary annular stepped inner surface.

11. In apparatus according to claim 9, wherein said air filter assembly includes an outwardly extending air filter assembly disposed externally of said reservoir which is readily accessible for cleaning and replacement without removal of said bottle.

12. A bottle seal and air filter apparatus adapted for use with liquid dispensing apparatus having a reservoir from which liquid is to be dispensed and which is provided with an upper rim surrounding an entrance into said reservoir, and a bottle which, when operably associated in an inverted orientation with said dispensing apparatus, has a neck portion inserted into said entrance of said reservoir, said bottle seal and air filter assembly comprising:

a breather ring including a gasket dimensioned for engagement with said upper rim;

a bottle neck seal supported by said breather ring and including a seat portion dimensioned for sealing engagement with a neck portion of said bottle; and an air filter connected to said breather ring for filtering ambient air passing through an air passage into said reservoir, said air filter including an outwardly extending air filter assembly disposed externally of said reservoir and radially outward of said rim such that said air filter is readily accessible for cleaning and replacement without removal of said bottle.

13. The apparatus of claim 12, wherein said bottle neck seal includes a first member having a plurality of annular steps on an outer surface and nested within a second member having a corresponding mating plurality of annular steps on an inner surface.

14. The apparatus of claim 12, further comprising:

a valve actuator funnel disposed between said bottle neck seal and air filter and said reservoir and at least partially disposed within said reservoir;

a valve member biased by a spring to a position normally closing said neck portion of said bottle; and a valve actuating probe in said valve actuator funnel, whereby insertion of said neck portion into said funnel suspended within said entrance of said reservoir will cause said valve actuating probe to move into registry with said valve member to open said neck portion for the release of liquid from said bottle into said reservoir.

15. In liquid dispensing apparatus, an assembly for interchangeable use with liquid-dispensing bottles having either a threaded neck for engagement with a threaded cap on the bottle or a radially enlarged rim for engagement with snap-on type caps comprising:

an adaptor having inner and outer circumferentially spaced walls defining an annular clearance space therebetween for insertion of the neck of the bottle, and a circular rim joining said walls together at one end, said outer wall including internal threads engageable with a bottle having a threaded neck and an internal groove engageable with a bottle having only a radially enlarged rim; and a valve unit secured to said inner wall for insertion through the neck of the bottle including means normally closing said valve unit to prevent removal of liquid contends from the bottle.

16. The apparatus of claim 15, wherein said valve unit is secured to said inner wall by a threaded connection.

17. The apparatus of claim 15, wherein said valve unit comprises a slide valve.

18. The apparatus of claim 15, further comprising a spring biasing said valve unit to a closed position.

19. The apparatus of claim 15, further comprising a circumferential ridge within said adaptor at least partially defining said groove.

20. The apparatus of claim 15, wherein said valve unit comprises:

a substantially cylindrical valve body secured to said inner wall;

at least one liquid inlet port in a sidewall portion of said valve body;

a substantially cylindrical valve piston received for reciprocal sliding movement in said valve body; and a spring biasing said valve piston to a closed position.

* * * * *